US008499379B2

(12) United States Patent
Ota et al.

(10) Patent No.: US 8,499,379 B2
(45) Date of Patent: Aug. 6, 2013

(54) ROBOTIC POSTURE TRANSFER ASSIST DEVICES AND METHODS

(75) Inventors: Yasuhiro Ota, Union, KY (US); Masaru Ryumae, Union, KY (US); Keiichi Sato, Chicago, IL (US); Shin Sano, Oak Park, IL (US); Srinidhi Kaushik, Chicago, IL (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 335 days.

(21) Appl. No.: 12/847,702

(22) Filed: Jul. 30, 2010

(65) Prior Publication Data

US 2012/0023660 A1 Feb. 2, 2012

(51) Int. Cl.

| | |
|---|---|
| ***A61G 5/00*** | (2006.01) |
| ***A61G 7/053*** | (2006.01) |
| ***A61G 1/00*** | (2006.01) |
| ***A61G 7/10*** | (2006.01) |

(52) U.S. Cl.

USPC ..... 5/81.1 R; 5/83.1; 5/85.1; 5/87.1; 5/88.1; 5/86.1; 5/84.1; 5/89.1

(58) Field of Classification Search

USPC ..... 5/81 R, 83.1–89.1

See application file for complete search history.

(56) References Cited

U.S. PATENT DOCUMENTS

| | | | | |
|---|---|---|---|---|
| 4,199,829 | A | 4/1980 | Watanabe et al. | |
| 5,123,131 | A * | 6/1992 | Jandrakovic | 5/85.1 |
| 5,428,851 | A | 7/1995 | Shore et al. | |
| 5,511,256 | A * | 4/1996 | Capaldi | 5/83.1 |
| 5,806,110 | A * | 9/1998 | Kunz et al. | 4/566.1 |
| 6,394,731 | B1 | 5/2002 | Konosu et al. | |
| 6,591,435 | B1 * | 7/2003 | Hodgetts | 5/88.1 |
| 6,742,206 | B1 | 6/2004 | Han | |
| 7,340,784 | B2 * | 3/2008 | Stryker et al. | 5/81.1 HS |
| 7,434,278 | B2 * | 10/2008 | White et al. | 5/81.1 R |
| 7,506,387 | B1 * | 3/2009 | Scordato et al. | 5/81.1 R |
| 7,540,044 | B2 * | 6/2009 | Patterson et al. | 5/81.1 C |
| 7,552,490 | B2 | 6/2009 | Saracen et al. | |
| 7,603,729 | B2 * | 10/2009 | Patterson | 5/81.1 HS |
| 2006/0123552 | A1 * | 6/2006 | Ben-Levi | 5/715 |
| 2008/0066228 | A1 | 3/2008 | Kume et al. | |
| 2008/0078030 | A1 | 4/2008 | Lee et al. | |
| 2008/0240349 | A1 | 10/2008 | Herrmann et al. | |
| 2008/0301872 | A1 * | 12/2008 | Fahrig et al. | 5/81.1 R |

(Continued)

FOREIGN PATENT DOCUMENTS

| | | |
|---|---|---|
| JP | 2009066696 | 4/2009 |
| WO | WO 2008/117538 A1 * | 10/2008 |

*Primary Examiner* — William Kelleher
*Assistant Examiner* — Eric Kurilla
(74) *Attorney, Agent, or Firm* — Dinsmore & Shohl LLP

(57) ABSTRACT

Robotic posture transfer assist devices for assisting a posture transfer of a patient in a bed may include a device body, a stabilizer coupled with the device body and the bed, and at least one robotic arm having a plurality of degrees of freedom, wherein the robotic arm may be coupled with the device body. Robotic posture transfer assist devices may further include an end-effector removably coupled with the robotic arm, a controller module that provides a control signal to the robotic arm to control a movement of the robotic arm about the plurality of degrees of freedom, and a user input device that provides a command signal to the controller module to command the movement of the robotic arm, wherein the control signal provided by the controller module corresponds with the command signal.

6 Claims, 11 Drawing Sheets

U.S. PATENT DOCUMENTS

2009/0184260 A1 7/2009 Huttenberger et al.
2009/0212478 A1 8/2009 Murayama
2010/0064431 A1 3/2010 Kawakami et al.
2010/0154117 A1* 6/2010 Odashima et al. ..... 5/87.1

* cited by examiner

ROBOTIC POSTURE TRANSFER ASSIST DEVICES AND METHODS

TECHNICAL FIELD

The present specification relates to devices and methods for adjusting the position of a patient and, more specifically, devices and methods for assisting in the posture transfer of a patient using a robotic device.

BACKGROUND

In hospitals or long-term care facilities, care-givers often need to reposition bed-bound patients to reduce the likelihood of the bed-bound patients getting conditions such as decubitus ulcers or bedsores. Repositioning a bed-bound patient typically requires multiple care-givers to manually move the patient into a different position. This may be particularly difficult for care-givers to do for elderly bed-bound patients whose joints have stiffened, as well as for overweight patients because repositioning these patients requires extensive effort by the care-giver.

Accordingly, a need exists for alternative devices and methods that provide assistance in the posture transfer of a patient that requires little intervention or assistance from the care-giver.

SUMMARY

In one embodiment, a robotic posture transfer assist device for assisting a posture transfer of a patient in a bed that may include a device body, a stabilizer coupled with the device body and the bed, and at least one robotic arm having a plurality of degrees of freedom, wherein the robotic arm may be coupled with the device body. The robotic posture transfer assist device may further include an end-effector removably coupled with the robotic arm, a controller module that provides a control signal to the robotic arm to control a movement of the robotic arm about the plurality of degrees of freedom, and a user input device that provides a command signal to the controller module to command the movement of the robotic arm, wherein the control signal provided by the controller module corresponds with the command signal.

In another embodiment, a robotic posture transfer assist device for assisting a posture transfer of a patient supported by a turning pillow in a bed that may include a device body, a stabilizer coupled with the device body and the bed, at least one robotic arm having a plurality of degrees of freedom, wherein the robotic arm is coupled with the device body. The robotic posture transfer assist device may further include a controller module that provides a control signal to control the movement of the robotic arm about the plurality of degrees of freedom and a user input device that provides a command signal to the controller module to command the movement of the robotic arm, wherein the control signal provided by the controller module corresponds with the command signal and the robotic posture transfer assist device assists a posture transfer of the patient by contacting the turning pillow with the robotic arm.

In yet another embodiment, a method for assisting a posture transfer of a patient in a bed using a robotic posture transfer assist device that may include locating the robotic posture transfer assist device adjacent to the bed, wherein the robotic posture transfer assist device includes a device body, a stabilizer coupled with the device body, at least one robotic arm having a plurality of degrees of freedom, wherein the robotic arm is coupled with the device body, an end-effector removably coupled with the robotic arm, a controller module that provides a control signal to control the movement of the robotic arm about the plurality of degrees of freedom, and a user input device that provides a command signal to the controller module to command the movement of the robotic arm. The method may further include coupling the robotic posture transfer assist device with the bed using the stabilizer, positioning and orientating the end-effector so that it is adjacent to the patient, and commanding the robotic arm to move using the user input device so that the end-effector contacts the patient.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Exemplary robotic posture transfer assist devices may assist a care-giver in adjusting the position of a patient by using the robotic arm to apply a force to the patient. The robotic posture device may includes a stabilizer that is positioned proximate to the robotic arm. The stabilizer prevents the bed from moving away from the robotic posture transfer device while force is being applied to the patient during a posture transfer. The stabilizer may be fitted with a bed engaging grip that mechanically couples the robotic posture transfer assist device to a support member of the bed. The robotic posture transfer assist device may also include a supplemental leg that engages with a support surface during a posture transfer and disengages from the support surface during transportation. The robotic posture transfer assist device may also include a stabilizing anchor that engages with a building structural member during a posture transfer and disengages from the building structural member during transportation. The supplemental leg and the stabilizing anchor prevent the robotic posture transfer assist device and the bed from moving during a posture transfer and allow movement of both the robotic posture transfer assist device and the bed at other times. Various embodiments of robotic posture assist devices and methods will be described in more detail herein.

Figure 1:
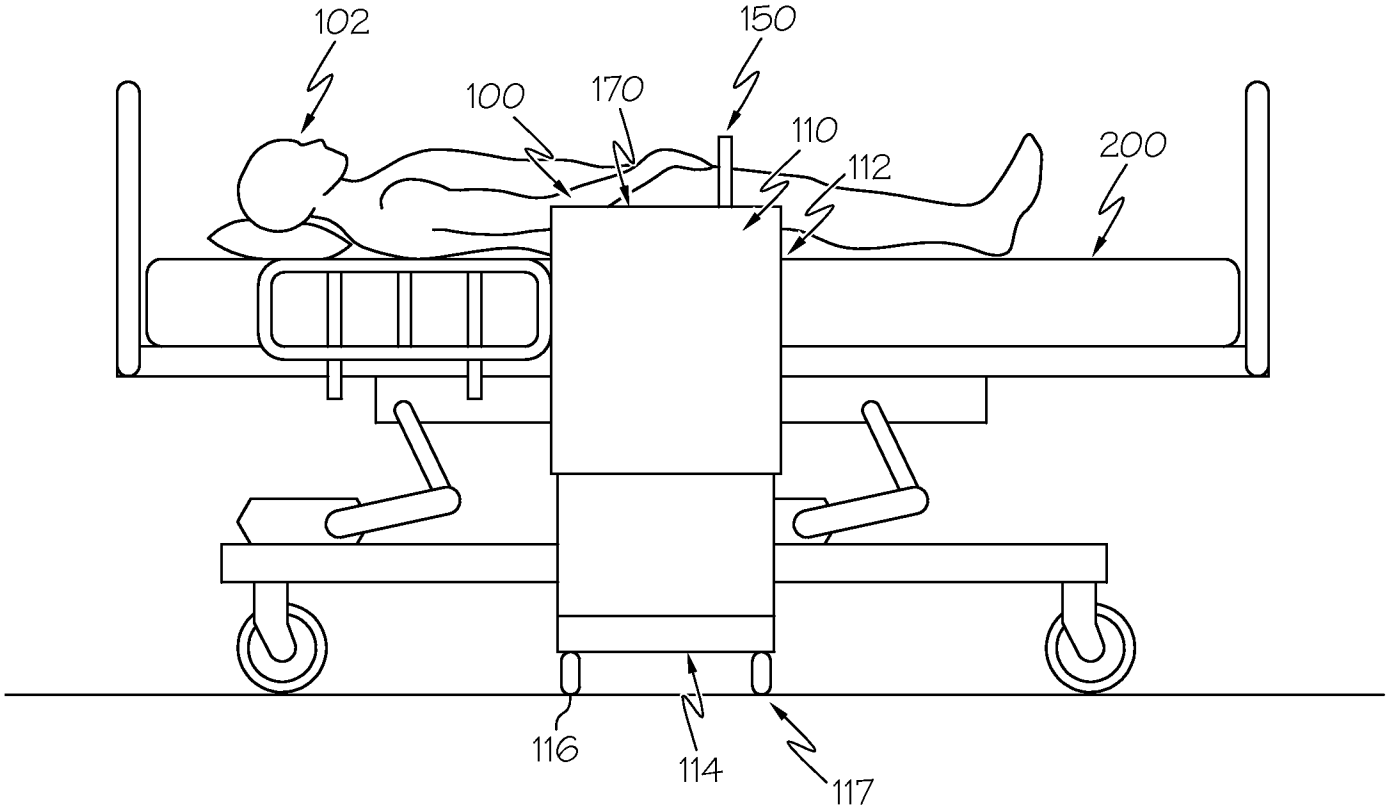
FIG. 1 illustrates a rear view of a posture transfer assist device according to one or more embodiments shown and described herein.
Figure 2:
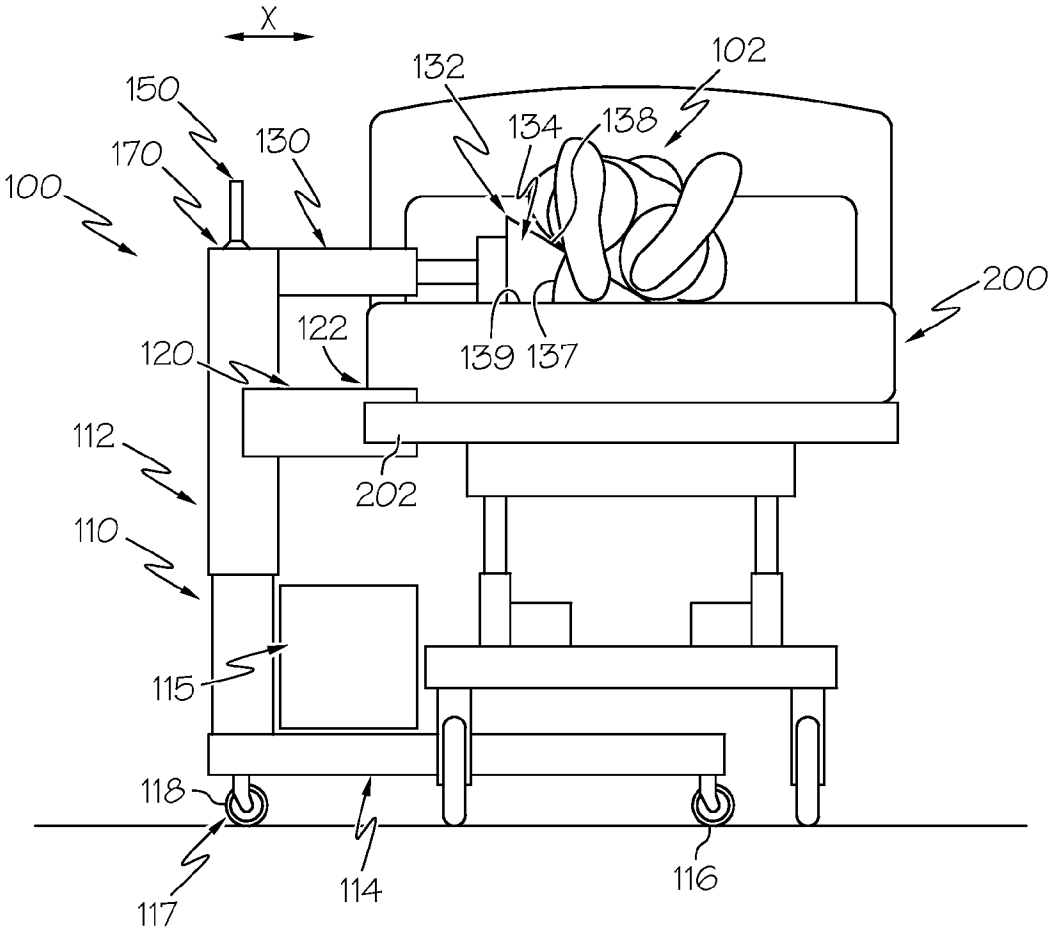
FIG. 2 illustrates a side view of a posture transfer assist device according to one or more embodiments shown and described herein.

Referring now to FIGS. 1 and 2, one embodiment of a robotic posture transfer assist device 100 is illustrated. As described in more detail herein, the robotic posture transfer assist device may be deployed in a facility such as a hospital, nursing home, long-term care facility, and the like, to aid care-givers in transferring the posture of a bed-bound patient 102. The illustrated robotic posture transfer assist device 100 may include a device body 110, a stabilizer 120, and a robotic arm 130. The robotic posture transfer assist device 100 may also include an end-effector 132 that is removably coupled with the robotic arm 130. The end-effector 132 may be placed proximate to the patient 102 and the robotic arm 130 may be commanded to move so that a the end-effector 132 applies a force to the patient 102 to change the patient's position in the bed 200.

The device body 110 comprises a body housing 112 and a lower support 114 comprising wheels 116 that allow the robotic posture transfer assist device 100 to be easily moved. A user interface 170 is coupled to the device body 110. The user interface 170 displays the location of the robotic arm 130 and accepts entry of parameters that affect the operation of the robotic arm 130 (e.g., height and weight of the patient 102 and maximum speed of the robotic arm 130). It should be understood that the user interface may be mounted on the robotic posture transfer assist device at a variety of locations. The device body 110 also comprises a power supply box 115 which may include a rechargeable battery pack to allow the robotic posture transfer assist device 100 to operate without being plugged into to a wall power outlet or an AC-DC converter.

The robotic arm 130 may be operated by a variety of actuation methods including hydraulic, electrical, or pneumatic actuators. The movement of the robotic arm 130 may be controlled through the use of a user input device 150. The robotic arm 130 may be back-drivable, meaning that when the robotic arm 130 actuator is off, the robotic arm 130 can be moved through the application of an external force. In particular, the robotic arm may have a high degree of back-drivability so that a user can move the robotic arm 130 with a minimum amount of force. This allows a user to position the robotic arm 130 and the end-effector 132 proximate to the patient 102 without having to use the user input device 150.

The end-effector 132 may be made from a variety of materials into a variety of shapes so that it is easily positioned adjacent to the patient 102. As shown in FIG. 2, the end-effector 132 may be a wedge-shaped pad 134 having a generally triangular-shaped end-section 136. The wedge-shaped pad 134 may be compliant to provide additional comfort to the patient 102 during a posture transfer. The wedge-shaped pad 134 provides an additional benefit such that the end-effector 132 is only translated horizontally towards the patient 102 in order to assist a posture transfer. The end-effector 132 may also include a tine, made of metal or plastic, that may be inserted below the patient 102 and then pitched to assist with a posture transfer.

The end-effector 132 may be removably coupled to the robotic arm 130 so that once a posture transfer has occurred, the end-effector 132 can be decoupled from the robotic arm 130 and remain in the bed 200 with the patient 102 to support the patient 102 in a new posture. The robotic posture transfer assist device 100 may then be moved to a different bed 200 and fitted with a different end-effector 132 to assist another patient 102 in a posture transfer.

The end-effector 132 may also be capable of changing shape in order to assist in a posture adjustment of the patient 102. For example, as illustrated in FIG. 2, the end-effector 132 may have an angle 137 defined by a first face 138 of the wedge-shaped pad 134 that is adjacent to the patient 102 and a second face 139 of the wedge-shaped pad 134 that is adjacent to the bed 200. The wedge-shaped pad 134 may be controlled to have a sharp angle 137 to ease insertion between the patient 102 and the bed 200. Once the wedge-shaped pad is inserted between the patient 102 and the bed 200, the angle 137 of the wedge-shaped pad 134 may be adjusted to have a more blunt angle 137. Additionally, the wedge shaped pad 134 may be detached from the robotic arm 130 and may have the angle 137 selectively adjusted to be more or less sharp, thus assisting in a posture transfer at a later time without further intervention of the robotic arm 130. The change in the sharpness of the angle 137 may be accomplished by a variety of methods including, for example, inflation and deflation of a pneumatic bladder included in the wedge-shaped pad 134.

Figure 3:
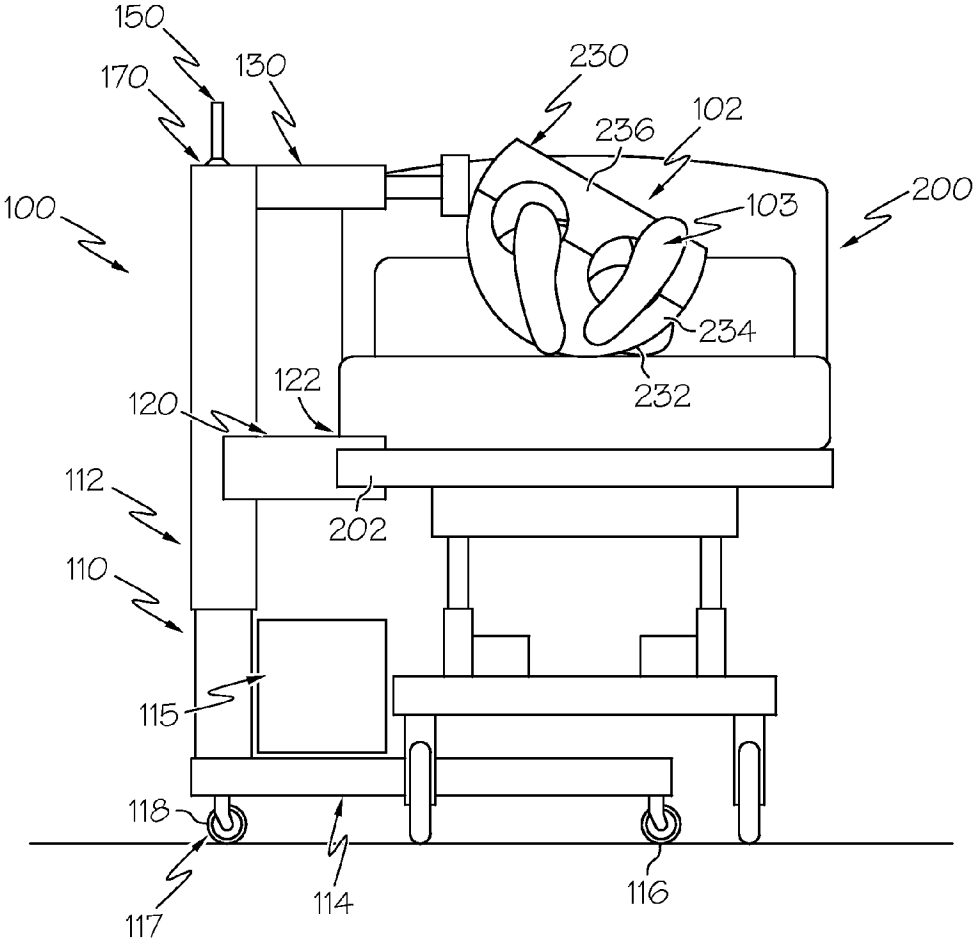
FIG. 3 illustrates a side view of a posture transfer assist device according to one or more embodiments shown and described herein.

Referring to FIG. 3, in one embodiment, portions of the patient's body may be supported by a turning pillow 230. The turning pillow 230 may have a generally cylindrical surface 232 that is positioned adjacent to the bed 200 to facilitate a posture transfer. The turning pillow 230 illustrated in FIG. 3 has a two piece construction, with a lower piece 234 that is placed below the patient's extremities 103, such as the patient's legs, and an upper piece 236 that is placed above the lower piece 234. The upper piece 236 and lower piece 234 can be connected to one another through a variety of attachment devices, for example, external latches or a hook-and-loop fastening system. Alternatively, the turning pillow 230 may have a single piece construction and the patient's extremities 103 can be slid into place. Once the patient's extremities 103 have been placed inside the turning pillow 230, the robotic posture transfer assist device 100 can be brought to the side of the bed 200. The stabilizer 120 is coupled to the bed 200 and the robotic arm 130 is commanded to move so that it touches the turning pillow 230. As the robotic arm 130 further extends, the robotic posture transfer assist device 100 may continue to transfer the posture of the patient 102 by manipulating the turning pillow 230 so that the turning pillow 230 rotates along the cylindrical surface 232.

The use of the turning pillow 230 may be particularly beneficial for a posture transfer of a patient 102 who retains some locomotive power, for example a patient 102 who has strength in his arms, but not in his legs. For such a patient 102, the turning pillow 230 provides assistance to the patient's legs but requires the patient 102 to use his arms to transfer his upper body posture. By not providing assistance to the patient's upper body, the patient 102 is required to exercise the muscles in his arms, conditioning them for future use.

As illustrated in FIGS. 1-3, the robotic posture transfer assist device 100 may include at least one motorized wheel 117 to assist with transportation of the robotic posture transfer assist device 100. The motorized wheel 117 may include a motor 118 that is configured to apply a torque to the motorized wheel when the motor 118 receives a drive signal from a care-giver. The care-giver may provide a drive signal to the motor 118 through the user input device 150 or the user interface 170. The motorized wheel 117 can then assist in transporting the robotic posture transfer assist device 100.

Figure 4:
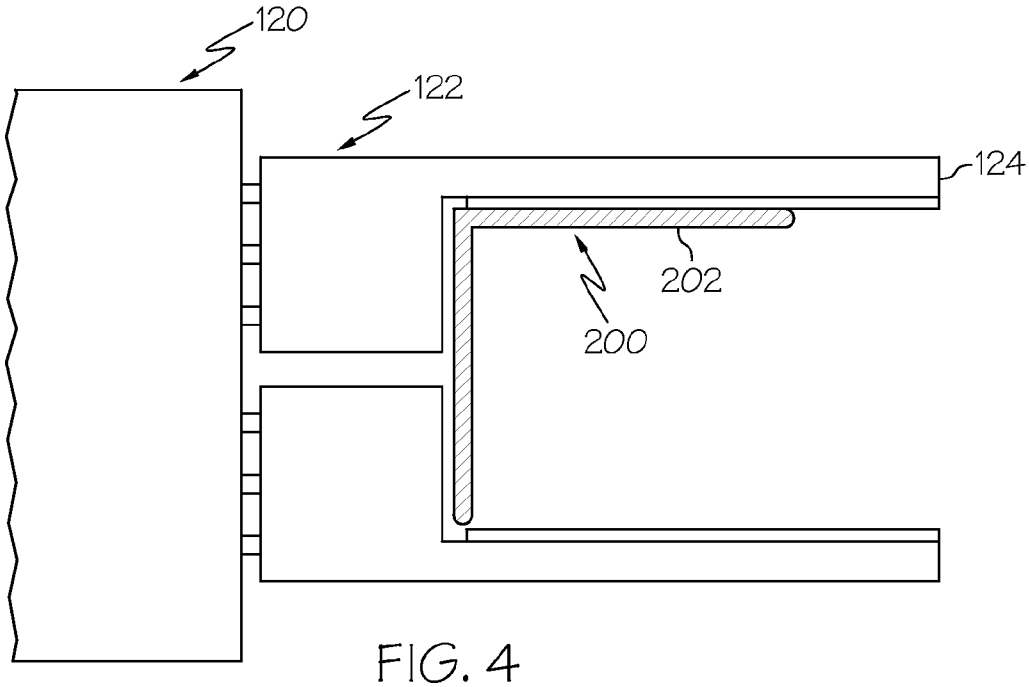
FIG. 4 illustrates a cross-section view of a stabilizer of a posture transfer assist device according to one or more embodiments shown and described herein.
Figure 5:
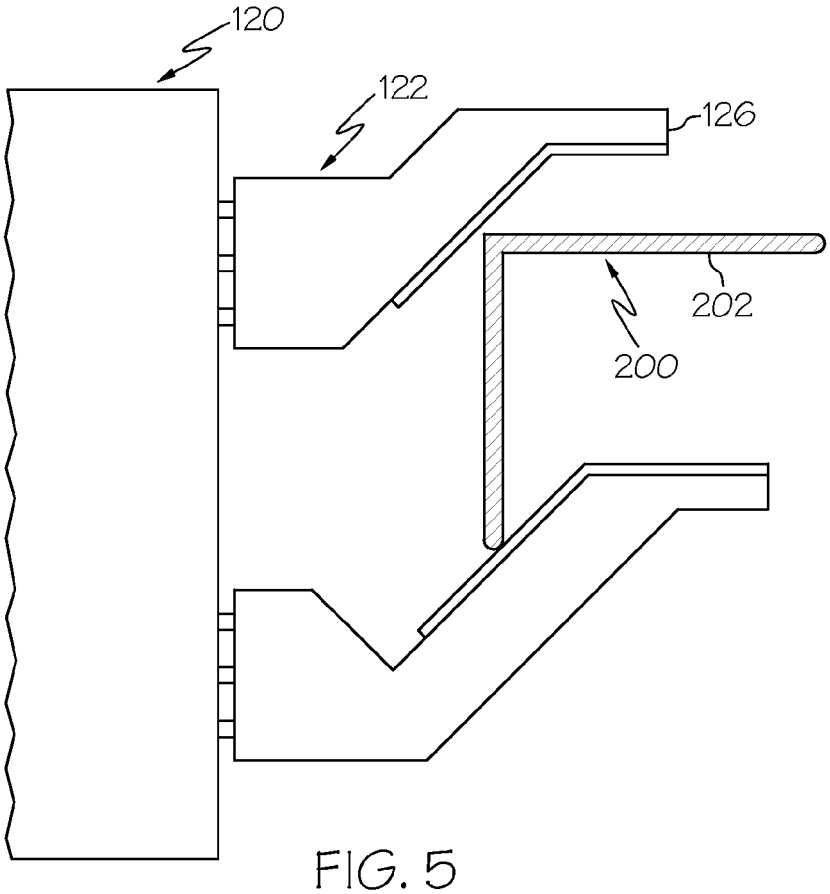
FIG. 5 illustrates a cross-section view of a stabilizer of a posture transfer assist device according to one or more embodiments shown and described herein.
Figure 6:
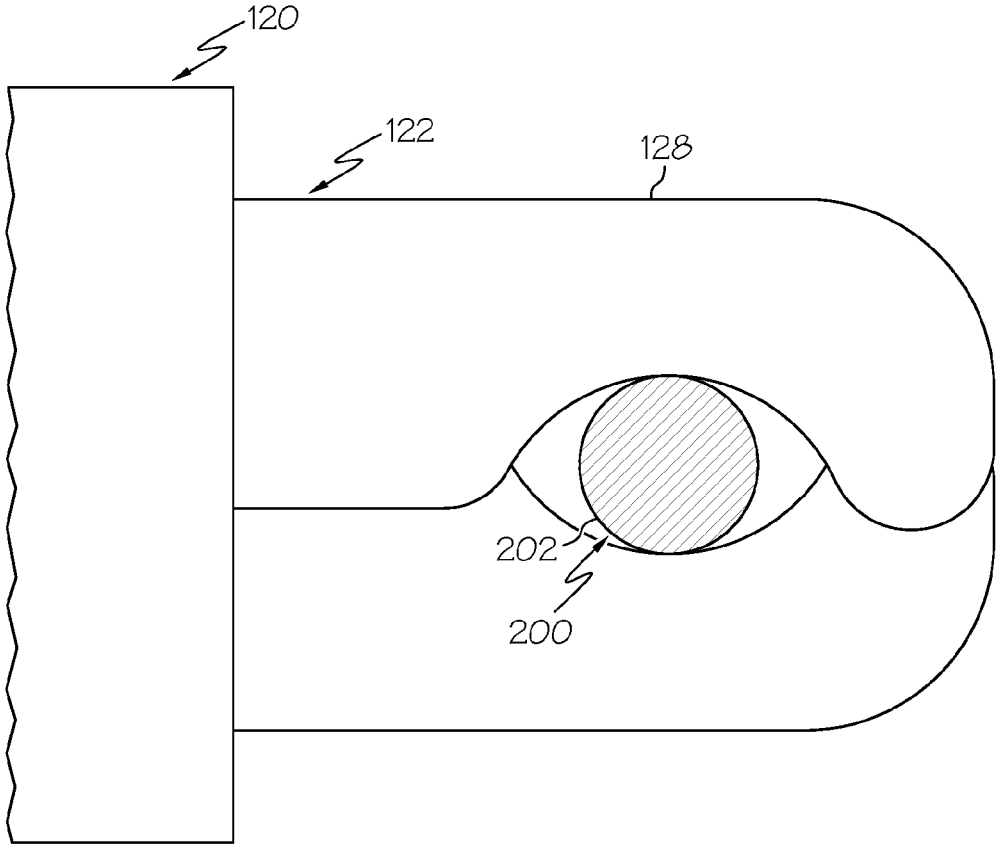
FIG. 6 illustrates a cross-section view of a stabilizer of a posture transfer assist device according to one or more embodiments shown and described herein.

Referring now to FIGS. 4-6, the bed engaging gripper 122 of the stabilizer 120 may take a variety of forms. For example, the bed engaging gripper 122 may include friction jaws 124, as illustrated in FIG. 4, that grip the support member 202 using the force of the bed engaging gripper 122. Friction jaws 124 may accommodate a variety of support member 202 shapes. The bed engaging gripper 122 may also include encompassing jaws 126, as illustrated in FIG. 5, that cradle the support member 202 for increased stability with reduced force applied by the bed engaging gripper 122. The friction jaws 124 and the encompassing jaws 126 may be remotely controlled through the user interface 170.

Additionally, the bed engaging gripper 122 may be provided with latching jaws 128, as illustrated in FIG. 6, that can couple the robotic posture transfer assist device 100 to a support member 202 of the bed 200 without applying force with a bed engaging gripper 122. The latching jaws 128 may be manually actuated to couple and decouple with the support member 202. Alternatively, the latching jaws 128 may be remotely controlled through the user interface 170 to couple and decouple with the support member 202.

The stabilizer 120 may couple with the support member 202 autonomously when the robotic posture transfer assist device 100 is located proximate to the bed 200. In one embodiment, the robotic posture transfer assist device 100 includes a sensing device, such as a camera, to determine the location of and orientation of an appropriate support member 202 of a bed 200.

Figure 7:
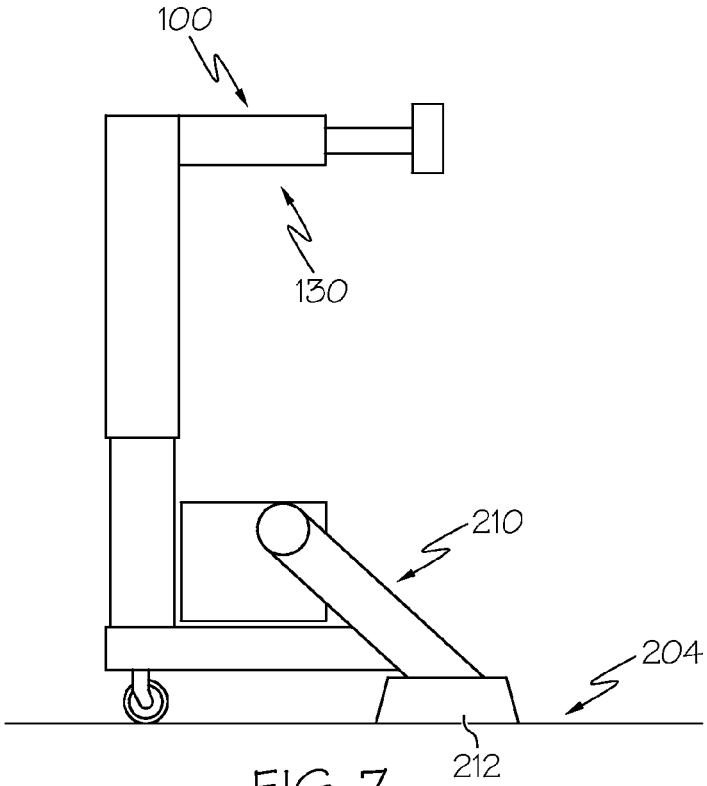
FIG. 7 illustrates a side view of a posture transfer assist device according to one or more embodiments shown and described herein.

Referring now to FIG. 7, the robotic posture transfer assist device 100 may also include a supplemental leg 210 that engages with a supporting surface 204, such as a floor, during posture transfer and disengages from the supporting surface 204 during transportation of the robotic posture transfer assist device 100. The supplemental leg 210 provides the robotic posture transfer assist device 100 with additional support to prevent the robotic posture transfer assist device 100 from moving during a posture transfer. The supplemental leg 210 may be attached to the device body 110 so that it provides a stabilizing reaction force in the direction of robotic arm 130 movement. As illustrated in FIG. 7, the supplemental leg 210 intersects the supporting surface 204 at an oblique angle, which may improve the stability of the robotic posture transfer assist device 100 than if angle were closer to orthogonal. Further, the supplemental leg 210 can be swung away from the supporting surface 204 when the robotic posture transfer assist device 100 needs to be transported. The supplemental leg 210 may also include a suction cup 212 that can couple the supplemental leg 210 to the supporting surface 204.

Figure 8:
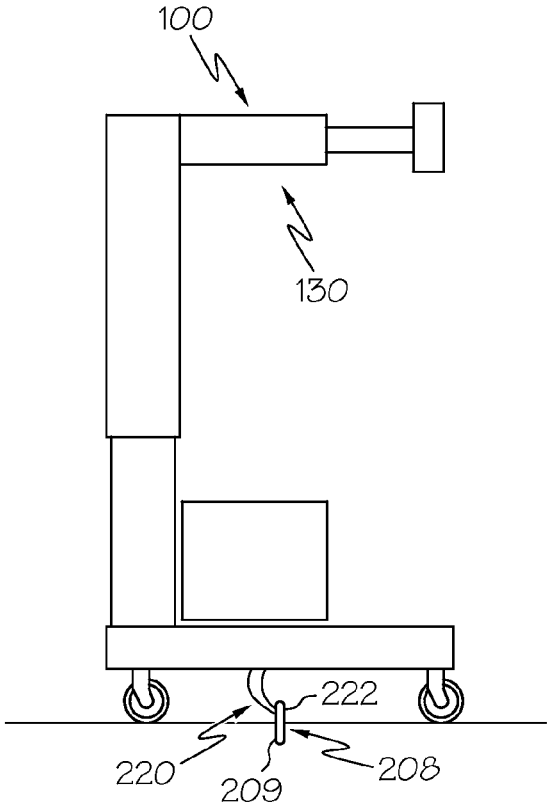
FIG. 8 illustrates a side view of a posture transfer assist device according to one or more embodiments shown and described herein.
Figure 9:
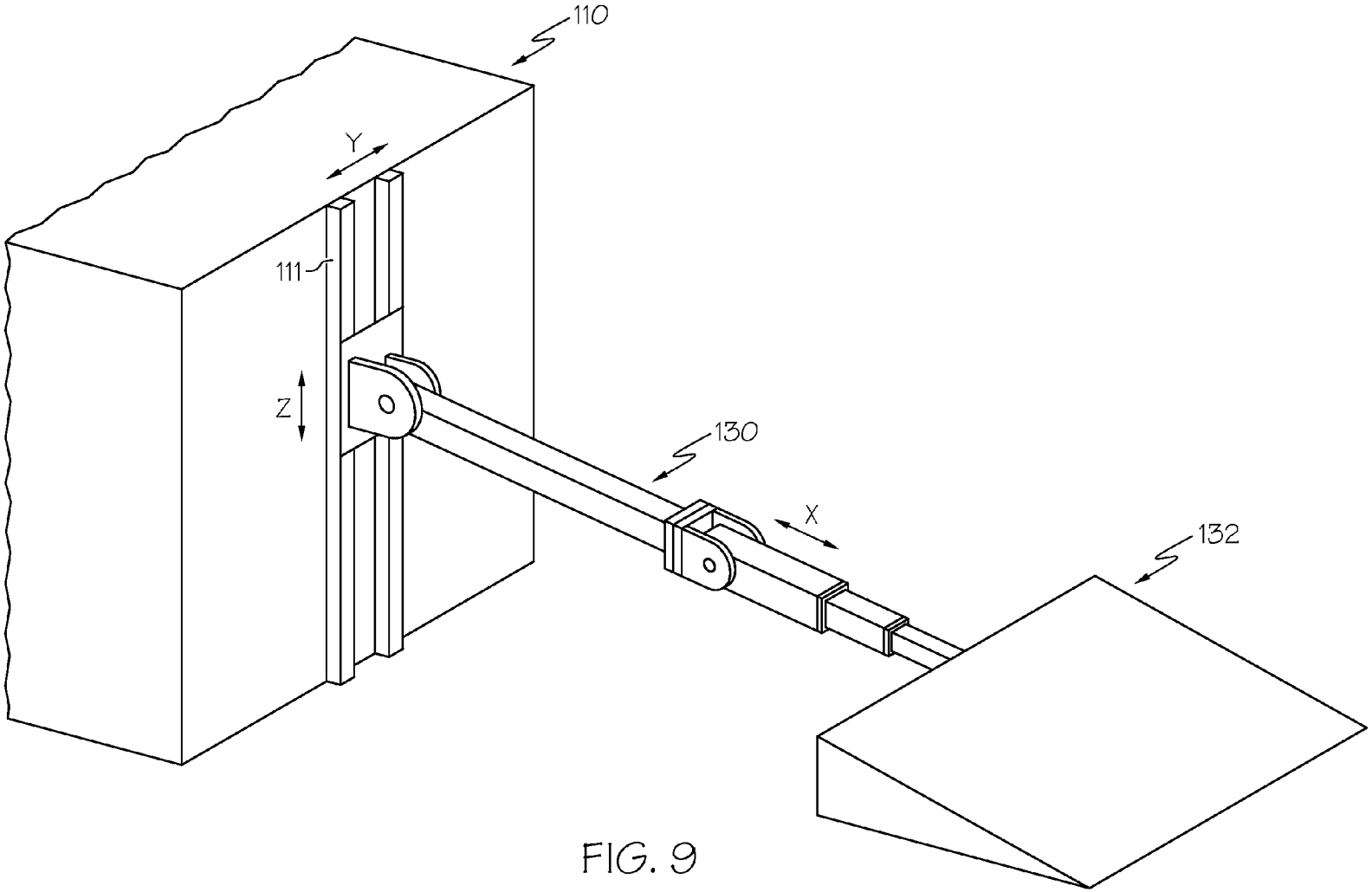
FIG. 9 illustrates a perspective top view of a robotic arm of a posture transfer assist device according to one or more embodiments shown and described herein.

Referring now to FIG. 8, in one embodiment, the robotic posture transfer assist device 100 includes a stabilizing anchor 220 that engages with a building structural member 208 during a posture transfer, and disengages from the building structural member 208 during transportation of the robotic posture transfer assist device 100. The stabilizing anchor 220 may include a hook 222 and the building structural member 208 may include a fastener having an opening, for example, a U-bolt or an eye-bolt. The building structural member 208 may also include a chain 209 or a cable that the stabilizing anchor 220 can attach to. The stabilizing anchor 220 may provide the robotic posture transfer assist device 100 with additional support to reduce the distance traveled by the robotic arm 130 during the posture transfer.

The robotic arm 130 may be operable to move about a plurality of degrees of freedom. Most simply, the robotic arm 130 illustrated in FIG. 2 moves in at least one degree of freedom, extensively as the robotic arm 130 moves the end-effector 132 towards and away from the patient (X arrow). As illustrated in FIGS. 9-13, the robotic arm 130 may have additional degrees of freedom in which it can move. For example, the robotic arm 130 may be able to move in three Cartesian coordinate directions, as illustrated by arrows X, Y, and Z in FIG. 9. The robotic arm 130 may be attached to the device body 110 through a gantry 111, which allows the robotic arm 130 to be positioned vertically (Z arrow) and longitudinally (Y arrow) with respect to the bed 200. The robotic arm 130 may be telescoping, which allows the robotic arm 130 to extend from the device body 110 (X arrow).

Figure 10:
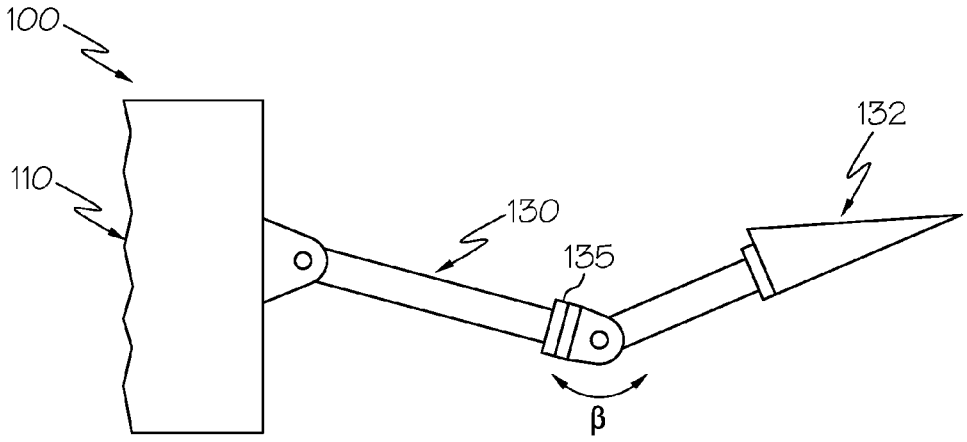
FIG. 10 illustrates a side view of a robotic arm of a posture transfer assist device according to one or more embodiments shown and described herein.
Figure 11:
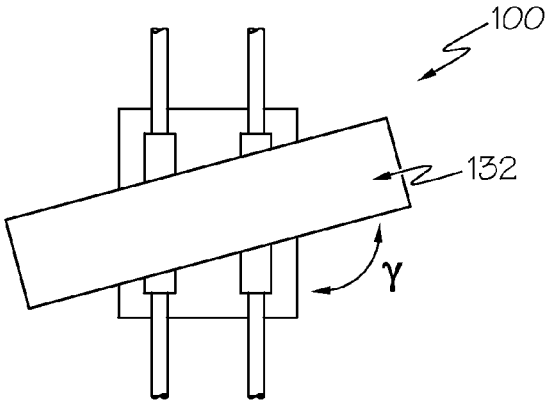
FIG. 11 illustrates a front view of a robotic arm of a posture transfer assist device according to one or more embodiments shown and described herein.
Figure 12:
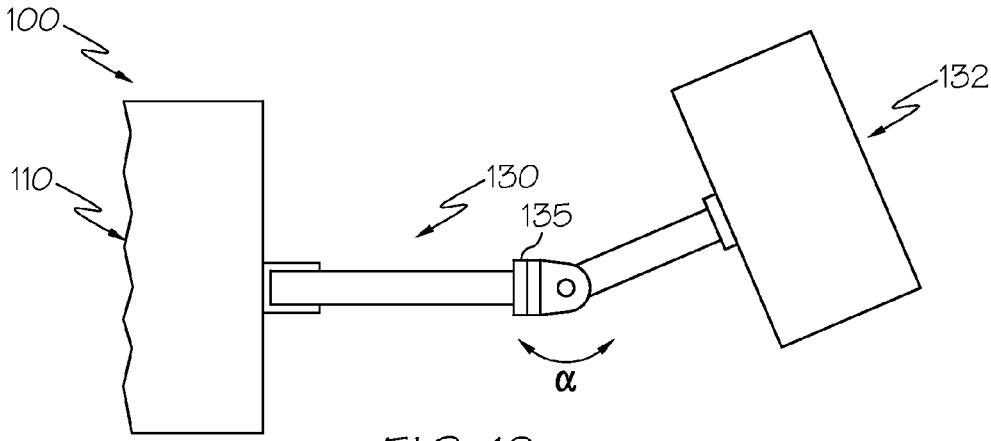
FIG. 12 illustrates a top view of a robotic arm of a posture transfer assist device according to one or more embodiments shown and described herein.

Referring to FIGS. 10-12, the robotic arm 130 may be operable to move so that the end-effector 132 can pitch, roll, and yaw, as illustrated by directional arrows $\beta$, $\gamma$, and $\alpha$, respectively. The robotic arm 130 may include a wrist joint 135 that allows the end effector to be positioned in these rotational directions. The movement in the longitudinal direction and the pitch, roll, and yaw rotations allow the robotic arm 130 to position and move the end-effector 132 to accommodate a patient 102 who is not aligned with the bed 200.

Figure 13:
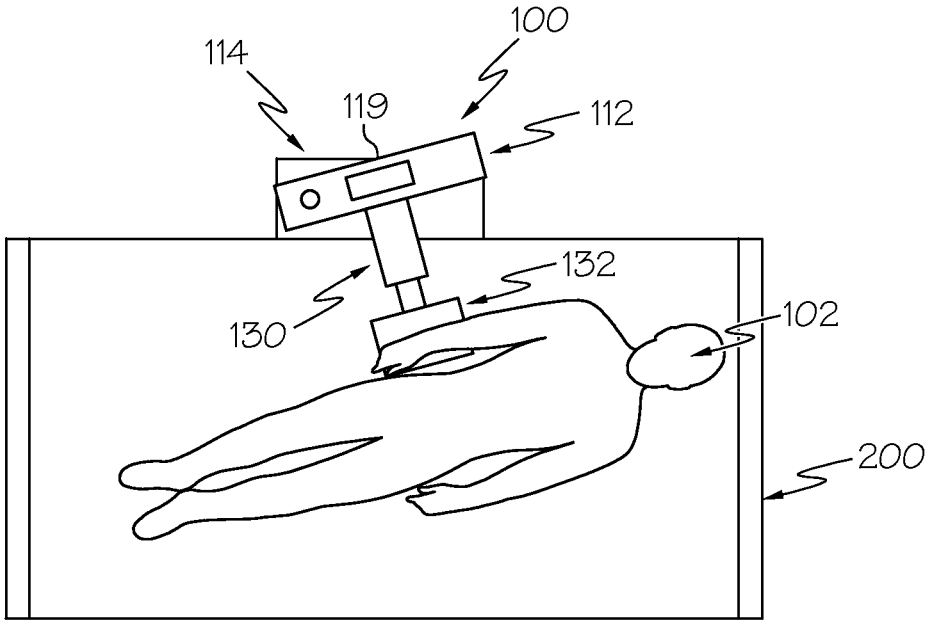
FIG. 13 illustrates a top view of a posture transfer assist device according to one or more embodiments shown and described herein.

Referring to FIG. 13, the device body 110 may include a rotary joint 119 that allows the body housing 112 to rotate relative to the lower support 114, so that end-effector 132 can yaw to accommodate a patient 102 who is not aligned with the bed 200 and the end-effector 132 can extend laterally along the direction of the robotic arm 130.

Figure 14:
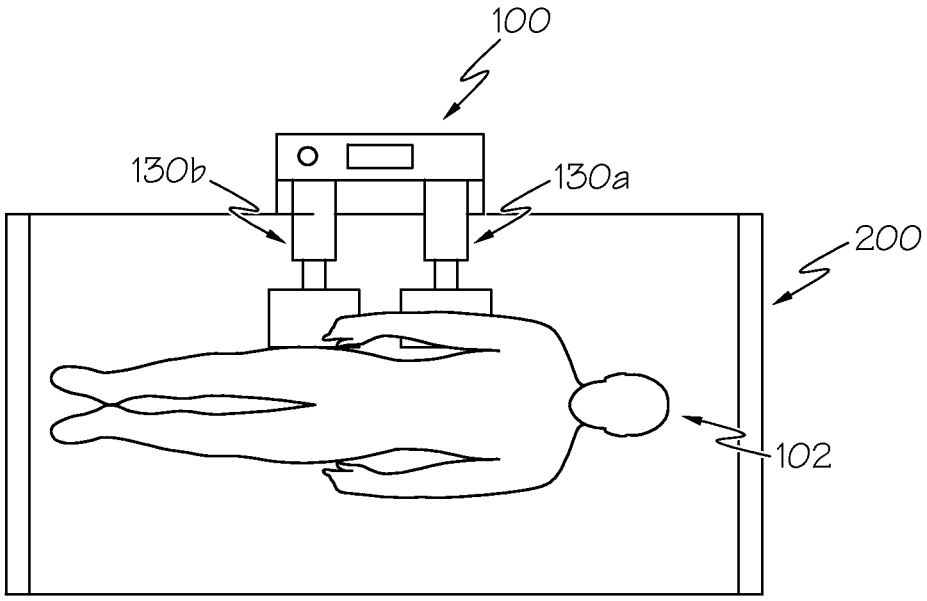
FIG. 14 illustrates a top view of a posture transfer assist device according to one or more embodiments shown and described herein.

Referring to FIG. 14, the robotic posture transfer assist device 100 may have a plurality of robotic arms **130*a*, 130*b*, each of which are operated independently of one another to apply a varying amount of force to the patient 102. Independent application of force may provide more precise control of a posture transfer than if a single robotic arm 130 were used. Although only two arms are illustrated in FIG. 14**, more than two arms may be utilized.

Figure 15:
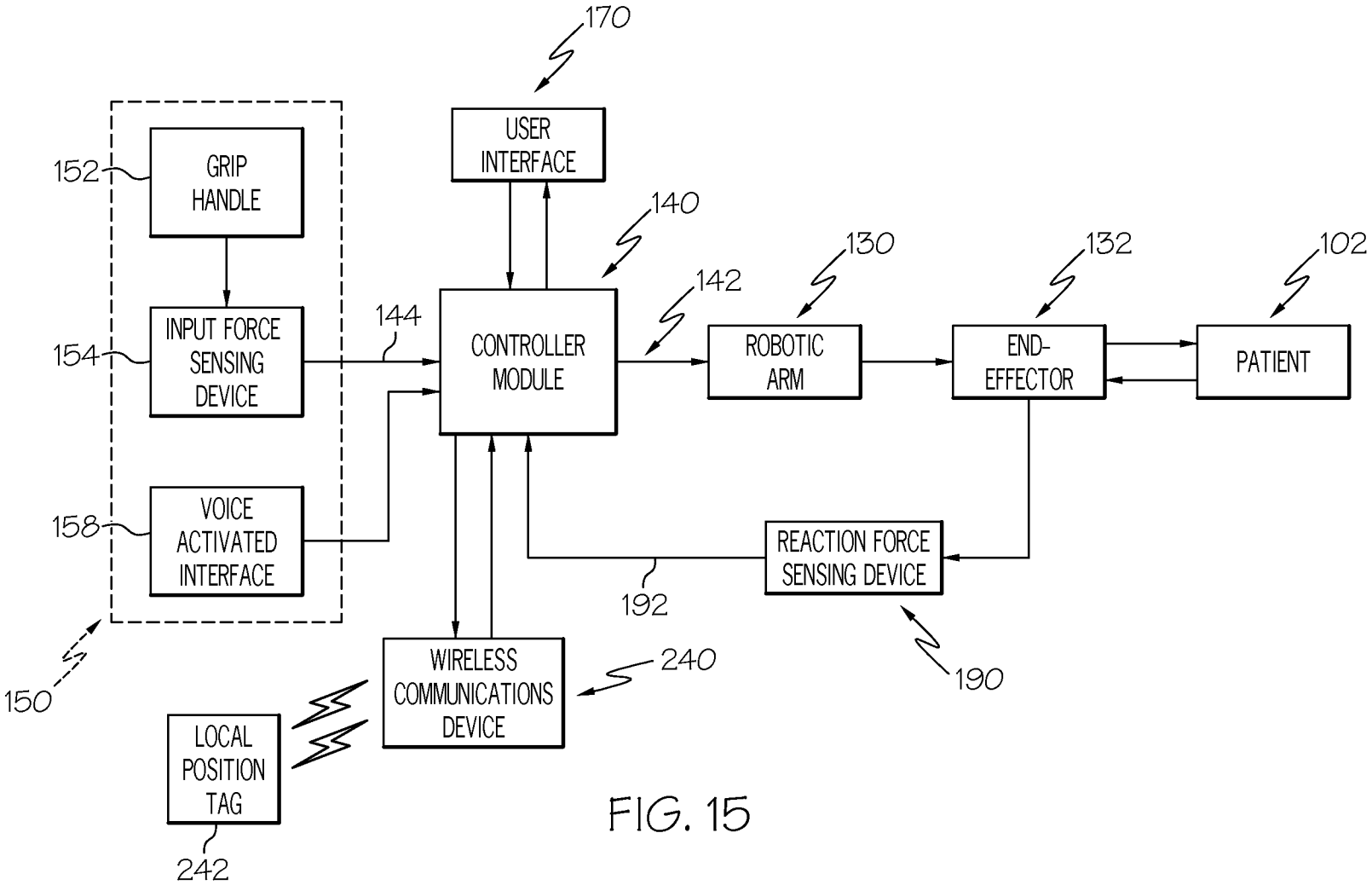
FIG. 15 illustrates a schematic drawing of a control system for a posture transfer assist device according to one or more embodiments shown and described herein.

Referring to FIG. 15, the robotic posture transfer assist device 100 may also include a controller module 140 that provides a control signal to the robotic arm 130 to control the movement of the robotic arm 130 about the degrees of freedom described above. The robotic posture transfer assist device 100 may also include a user input device 150 that provides a command signal 144 to the controller module 140 to command the movement of the robotic arm 130. The controller module 140 may include a computer that processes a command signal 144 provided by a user input device 150 and outputs a corresponding control signal 142 to the robotic arm 130 to control a movement of the robotic arm 130 about its plurality of degrees of freedom.

Figure 16:
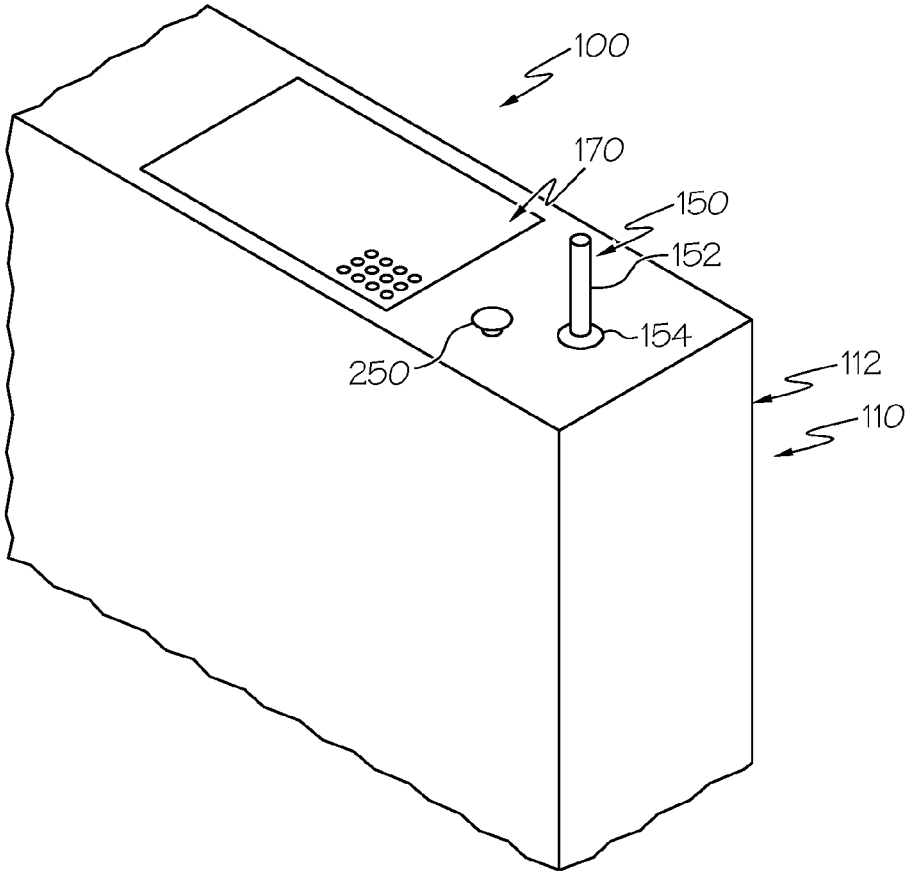
FIG. 16 illustrates a perspective top view of a user interface and a user input device of a posture transfer assist device according to one or more embodiments shown and described herein.

The user input device 150 may include a grip handle 152 and a input force sensing device 154, as illustrated in FIG. 16, which detects a force applied to the grip handle 152. In one embodiment, the grip handle 152 may resemble a joystick, but is generally not movable. A user applies a directional force to the grip handle 152. Referring again to FIG. 15, the input force sensing device 154 may sense this directional force in a plurality of directions and rotations, and output a command signal 144 to the controller module 140. The controller module 140 may process this command signal 144 and output a corresponding control signal 142 to the robotic arm 130, commanding the robotic arm 130 to move in one or more of its plurality of degrees of freedom. The input force sensing device 154 may output a command signal 144 that corresponds to the magnitude of the force applied to the grip handle 152. The grip handle 152 may have a plurality of operating modes so that all of the degrees of freedom of the robotic arm 130 can be controlled from a single grip handle 152.

Similarly, the user input device 150 may include a movable joystick that outputs a command signal 144 to the controller module 140 to move the robotic arm 130 in one or more of its plurality of degrees of freedom. The controller module 140 may command the robotic arm 130 to move at a speed that corresponds to the distance the joystick is displaced from its center axis. The movable joystick may have a plurality of operating modes so that all of the degrees of freedom of the robotic arm 130 can be controlled from a single movable joystick.

Still referring to FIG. 15, the user input device may 150 also include a voice activated interface 158 that may interpret a verbal command to move the robotic arm 130 in one or more of its plurality of degrees of freedom.

Any of the embodiments of the user input device 150 may be placed proximate to the patient 102 so that the patient 102 can operate the robotic arm 130 to assist with a posture transfer without assistance from a third party.

The robotic posture transfer assist device 100 may also include an emergency stop button 250, as illustrated in FIG. 16, placed so that it may easily be reached by the patient 102 or a third party operator, in the event of a malfunction of the robotic posture transfer assist device 100. The emergency stop button 250 may be configured to interrupt all power to robotic posture transfer assist device 100. Alternately, the emergency stop button 250 may be configured to interrupt power to the robotic arm 130, while leaving the remaining components powered so that the status of the machine can be read from the user interface 170.

Figure 17:
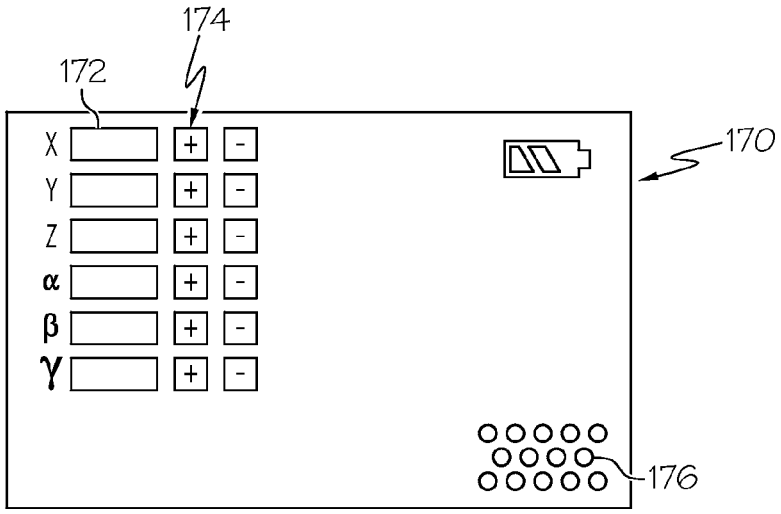
FIG. 17 illustrates a top view of a user interface of a posture transfer assist device according to one or more embodiments shown and described herein.

The robotic posture transfer assist device 100 may further include a user interface 170 that is used to monitor the status of the robotic posture transfer assist device 100. As illustrated in FIG. 17, the user interface 170 may include a display 172 for listing the current position and orientation of the robotic arm 130 and the end-effector 132, the commanded position and orientation of the robotic arm 130 and the end-effector 132, the operational mode of the robotic posture transfer assist device 100, and the power status of the robotic posture transfer assist device 100. The user input device 150 may be integrated into the user interface 170, so that the user interface 170 includes a series of buttons 174 to allow a user to control the motion of the robotic arm 130 about its plurality of degrees of freedom. The user interface 170 may include a touchscreen that allows the robotic posture transfer assist device 100 status to be displayed alongside virtual buttons. The user interface 170 may also include a microphone 176 to allow a user to make a verbal command to the voice activated interface 158.

The user interface 170 may further include the ability to enter operational information about the posture transfer. For example, general physical dimensions of the patient, such as height and weight, and situation characteristics, such as bed height, patient orientation, and maximum robotic arm speed, may be entered into the user interface 170. These parameters can be used by the controller module 140 to determine the proper control signal 142 to pass to the robotic arm 130. For example, an overweight patient requires greater force to transfer posture than a non-overweight patient. By entering the patient's weight into the user interface 170, the controller module 140 can compensate and allow the actuators of the robotic arm 130 to apply a greater force to the patient 102.

Referring again to FIG. 13, in one embodiment, the robotic posture transfer assist device 100 also includes a reaction force sensing device 190. The reaction force sensing device 190 detects a reaction force applied to the robotic arm 130 when the end-effector 132 contacts the patient 102. The reaction force sensing device 190 provides a reaction force signal 192 to the controller module 140, which can then determine if a correction should be made to the control signal 142. For example, the reaction force sensing device 190 can report to the controller module 140 if there is a sudden force applied to the end-effector 132, and if the movement of the robotic arm should be stopped. Using the reaction force signal 192 supplied by the reaction force sensing device 190, the controller module 140 may also determine if the end-effector 132 is making sufficient contact with the patient 102. Additionally, the controller module 140 may evaluate the reaction force signal 192 and compare the force that is measured with a pre-determined force limit that may be set based on the patient's general physical dimensions, such as height and weight, and entered into the user interface 170. The controller module 140 may also control the movement of the robotic arm 130 based on the command signal 144 and the reaction force signal 192 so that the pre-determined force limit is not exceed.

The robotic posture transfer assist device 100 may also include a wireless communications device 240 that can be activated by the patient 102 or a third party. The wireless communications device 240 may be used to summon a care-giver for assistance or may be used as a wireless intercom to communicate with a care-giver who is remote from the robotic posture transfer assist device 100.

In one embodiment, the robotic posture transfer assist device 100 is configured to move autonomously through a care facility. The wireless communications device 240 may be able to receive wireless signals from various sources. The wireless communications device 240 may be communicatively coupled to a wireless communications network. Generally, the wireless communications device 240 may receive wireless signals that are indicative of a location of the robotic posture transfer assist device 100 within the care facility, a location of one or more beds, and locations of obstacles. The wireless signals may also correspond with navigation data received from a central server that is also communicatively coupled to the wireless communications network. The wireless communications device 240 may also transmit wireless signals to the central server and other devices to navigate within the care facility.

The robotic posture transfer assist device 100 may determine its location within the care facility by detecting a plurality of local position tags 242 that are located throughout a care facility. The local position tags 242 may be located on walls, obstacles, or other locations. The local position tags 242 may emit a wireless location signal (e.g., a radio-frequency identification signal) that is uniquely addressed. The wireless communications device 240 and controller module 140 may receive the wireless signals as proximity data from the local position tags 242. The proximity data corresponding to the signals from the local position tags 242 may be provided to the controller module 140. The controller module 140 may use the proximity data to determine a position of the robotic posture transfer assist device 100 within the care facility. The position may then be used to navigate the robotic posture transfer assist device 100 throughout the care facility in accordance with a calculated navigation route. The navigation route may be calculated by the controller module 140. The local position tags 242 may define areas of the care facility that are restricted to prevent the robotic posture transfer assist device 100 from entering such areas. Infrared and/or ultrasonic sensors may also be used for collision avoidance. The robotic posture transfer assist device 100 may also use other methods of determining a location within a care facility, such as a global positioning system, for example.

It should now be understood that the robotic posture transfer assist devices described herein comprise a robotic arm that assists a care-giver in the posture transfer of a patient in a bed and a stabilizer that couples the robotic posture transfer assist device to the bed during a posture transfer. In particular embodiments, the robotic posture transfer assist device may also include a supplemental leg and a stabilizing anchor that selectively engage the robotic posture transfer assist device in a fixed position during a posture transfer.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A robotic posture transfer assist device for assisting a posture transfer of a patient supported in a bed, the robotic posture transfer assist device comprising:

a device body;

a stabilizer coupled with the device body and the bed;

at least one robotic arm having a plurality of degrees of freedom, wherein the robotic arm is coupled with the device body;

a controller module that provides a control signal to control the movement of the robotic arm about the plurality of degrees of freedom;

a user input device that provides a command signal to the controller module to command the movement of the robotic arm; and a turning pillow capable of supporting at least a portion of the patient, the turning pillow comprising a lower piece having a cylindrical surface capable of being positioned proximate to the bed, the lower piece capable of being positioned beneath the patient's extremities, and an upper piece coupled to the lower piece and positioned above the lower piece, wherein the control signal provided by the controller module corresponds with the command signal and the robotic posture transfer assist device assists a posture transfer of the patient by contacting the turning pillow with the robotic arm as to rotate the turning pillow along the cylindrical surface.

2. The robotic posture transfer assist device as claimed in claim 1, wherein the stabilizer comprises a bed engaging grip positioned proximate to the robotic arm, wherein the bed engaging grip is configured to engage a support member associated with the bed.

3. The robotic posture transfer assist device as claimed in claim 1 further comprising at least one supplemental leg, wherein the supplemental leg is engaged with a supporting surface during a posture transfer and disengaged from the supporting surface during transportation of the robotic posture transfer assist device.

4. The robotic posture transfer assist device as claimed in claim 3, wherein the supplemental leg comprises a suction cup that couples with the supporting surface.

5. The robotic posture transfer assist device as claimed in claim 1 further comprising a stabilizing anchor, wherein the stabilizing anchor is engaged with a building structural member during a posture transfer and disengaged from the building structural member during transportation of the robotic posture transfer assist device.

6. The robotic posture transfer assist device as claimed in claim 5, wherein the stabilizing anchor comprises a hook and the building structural member comprises a chain.

* * * * *

UNITED STATES PATENT AND TRADEMARK OFFICE

CERTIFICATE OF CORRECTION

PATENT NO. : 8,499,379 B2
APPLICATION NO. : 12/847702
DATED : August 6, 2013
INVENTOR(S) : Yasuhiro Ota et al.

It is certified that error appears in the above-identified patent and that said Letters Patent is hereby corrected as shown below:

On the Title Page

Addition of the following item (73) assignee:

Illinois Institute of Technology, Chicago, IL (US).

Signed and Sealed this
Twenty-second Day of July, 2014

Michelle K. Lee

Michelle K. Lee
*Deputy Director of the United States Patent and Trademark Office*